United States Patent [19]

Mistarz

[11] 4,326,567

[45] Apr. 27, 1982

[54] VARIABLE VOLUME, POSITIVE DISPLACEMENT SANITARY LIQUID DISPENSING MACHINE

[75] Inventor: Robert J. Mistarz, Northbrook, Ill.

[73] Assignee: Vercon Inc., Coleman, Mich.

[21] Appl. No.: 107,324

[22] Filed: Dec. 26, 1979

[51] Int. Cl.[3] ..... B65B 3/04; B65B 3/32

[52] U.S. Cl. ..... 141/90; 141/98; 141/147; 141/152; 222/148; 222/287; 222/309; 222/318

[58] Field of Search ..... 134/22 R, 22 C, 152, 134/166 R; 141/89, 90, 91, 144–152, 177, 392, 98; 222/148, 287, 168.5, 309, 318

[56] References Cited

U.S. PATENT DOCUMENTS 3,580,302 5/1971 Riesenberg ..... 141/152 X 3,601,288 8/1971 Berry et al. ..... 222/168.5

3,964,526 6/1976 Sindermann ..... 141/90 X 4,051,878 10/1977 Ohmeis et al. ..... 141/152 X

*Primary Examiner*—Frederick R. Schmidt

*Attorney, Agent, or Firm*—Learman & McCulloch

[57] ABSTRACT

A filling machine for dispensing sometimes viscous liquid in measured amounts to containers wherein a carrier supports a plurality of individual containers with open upper ends for lateral orbiting movement with a central tank, a pump and valve assembly orbits with the carrier and has a plurality of rotary valves, communicating with outward passages from the tank and with piston pumps, and also communicating the piston pumps with dispensing openings arranged above the containers. The pistons of the pumps are controlled by a pivotal cam track which can be swung to various positions to change the extent of the suction stroke of each piston, when operated by an actuating member. The machine is particularly designed for disassembly and for cleaning.

15 Claims, 8 Drawing Figures

VARIABLE VOLUME, POSITIVE DISPLACEMENT SANITARY LIQUID DISPENSING MACHINE

BACKGROUND OF THE INVENTION

The invention particularly relates to container filling machines of the type useful in the environment designated in U.S. Pat. No. 3,800,400 and more particularly relates to improvements in machines of the type disclosed in U.S. Pat. No. 3,601,288. While not limited to the dispensing of charges of material into plastic containers, the machine is particularly useful in dispensing a predetermined quantity of fluid, or semi-fluid product from a supply which is contained in a tank or the like, and typical products may include yogurt and milk.

One of the prime objects of the present invention is to design an extremely sanitary machine which dispenses only metered volumes of material to the containers, and is capable of readily dispensing different metered charges to containers of different size, with only a simple and convenient pump stroke varying mechanism.

Still another object of the invention is to provide a filling machine of the character described which positively prevents the dispensing of product to a container pedestal to which no container has, in fact, been delivered in a most reliable and economical manner.

Still another object of the invention is to provide a construction which can be readily cleaned, and readily reassembled.

SUMMARY OF THE INVENTION

A sanitary filling machine with a carrier for individual containers and surrounding a central supply tank, is rotated with the tank and rotary valves are provided which in one position feed material from tank outlet passages to a plurality of positive displacement pistons, and in another position permit the pumping of material by the pistons through dispensing openings to the container, a cam track for determining the lower position of each pump piston in the suction stroke is swingable to various adjusted positions to meter material to the container according to the volume of the containers being filled. The mechanism is constructed to facilitate cleaning.

Other objects and advantages of the invention will be pointed out specifically or will become apparent from the following description when it is considered in conjunction with the appended claims and the accompanying drawings, in which:

Figure 1:
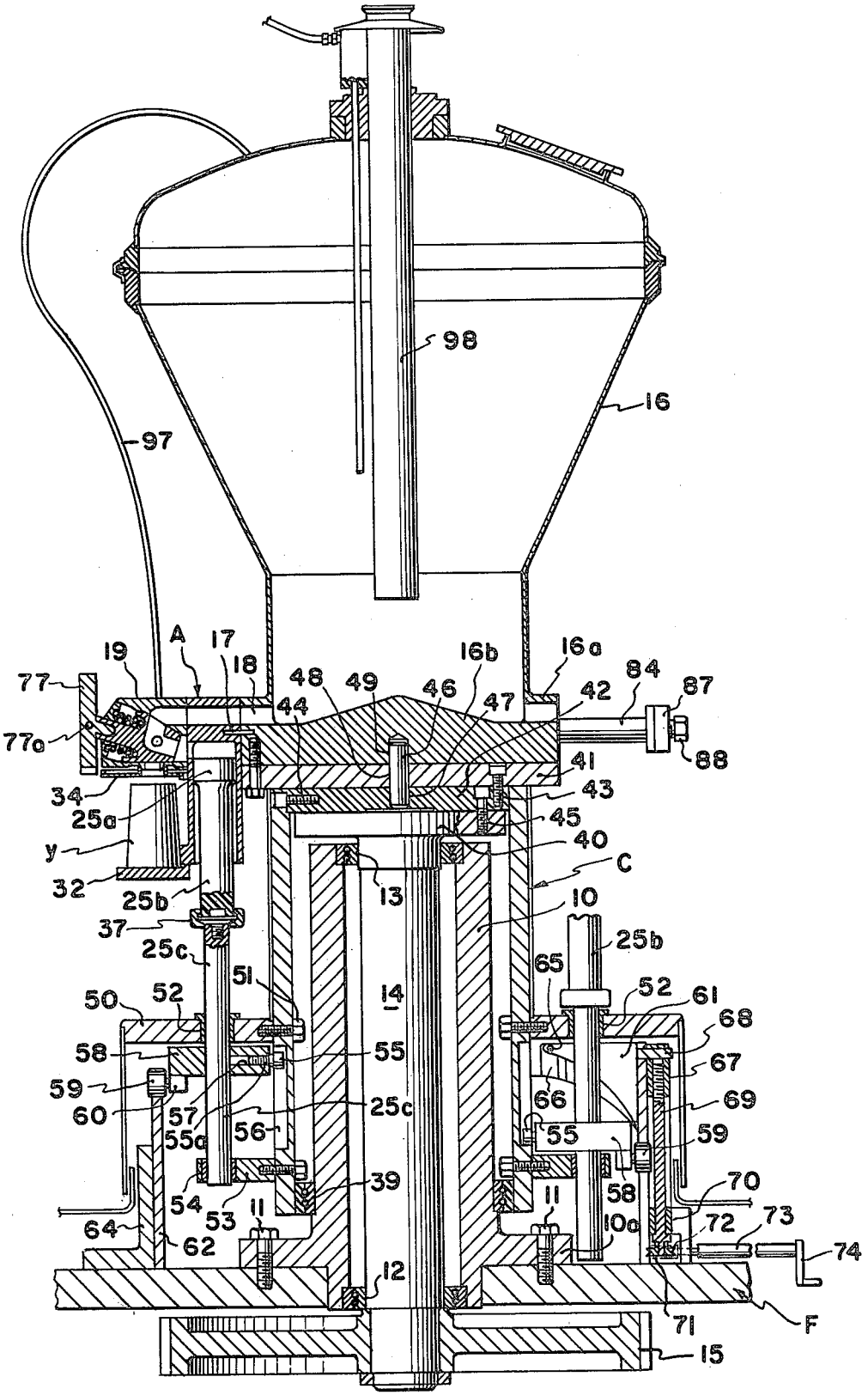
FIG. 1 is a fragmentary, sectional, side elevational view of the filling machine.

Referring now more particularly to the accompanying drawings, the machine is shown as having a frame F supporting an upstanding sleeve 10 which has a flange 10*a* bolted to the frame at 11. Bearings 12 and 13 mounted by sleeve 10 journal a central shaft 14 which is adapted to be driven by a spur gear 15 connected with any suitable source of rotary power.

A tank mounting orbiting assembly, to be later described, supports a liquid-filled tank 16 for rotation with the shaft 14. Also mounted for rotation with the assembly are a plurality of pump housing assemblies A, pins 17 being provided to secure the housings A in place surrounding the outlet portion 16*a* of tank 16 as shown. It is to be understood that the outlet portion 16*a* has an outlet passage 18 and that the number of assemblies A depend on how many containers are to be supported on the machine and filled during the revolution of shaft 14. The passages 18 are in radial alignment with passages 18*a* provided in the pump housing assemblies A, which, as FIG. 2 indicates, are sandwiched between the tank outlet portion 16*a* and a plurality of valve mounting and material dispensing housing assemblies 19 which are mounted outboard radially of each pump housing assembly A. As FIG. 2 indicates, seal rings 20 are provided around outlet portion 18 in slots 21 provided in each housing A to seal passages 18 and 18*a* at the juncture of housings A and 16*a*, and circular seal rings 22 are provided in slots 23 in the housing assemblies 19 to seal the passages 18*a* and passages 19*a* provided in the assemblies 19 at the juncture of the housings 19 and A.

Figure 2:
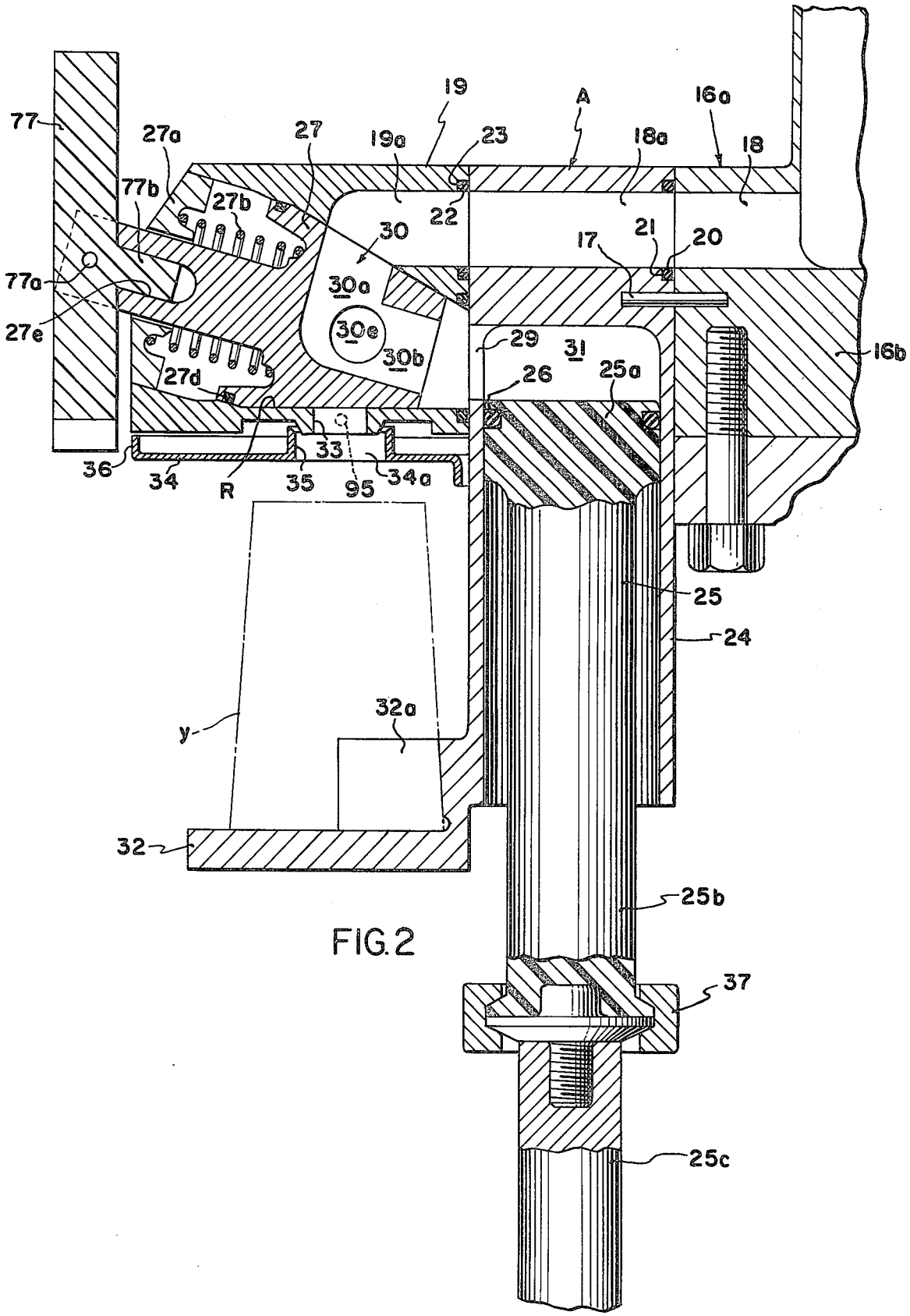
FIG. 2 is an enlarged, fragmentary, sectional, elevational view more particularly illustrating the dispensing valve assembly and associated parts.

Each pump assembly housing A includes a dependent cylinder 24 within which a piston pump 25 is mounted, the upper part of each piston pump 25 (which is designated 25*a*) being slotted to receive a sealing O-ring 26 as shown. Each assembly 19 is provided with a frustoconically shaped recess R communicating with an associated passage 19*a* to receive a rotary frustoconical valve 27 which later will be more particularly described, and it will be seen that a pump cylinder 24 is positioned opposite each recess R and valve 27. Springs 27*b* retained by removable retainers 27*a* secured in the outer ends of the recesses R urge valves 27 inwardly and a sealing ring 27*d* is provided as shown. Openings 29 are provided in the radial outer wall of each pump cylinder 24, so that when a valve 27, with its port system 30, is in the position shown in FIG. 2, it communicates the passage 19*a* with the filling passage 31 above piston 25*a* via a port 29. Each port system 30 includes ports 30*a* and 30*b*, and a port 30*e* perpendicular to port 30*b*, and in the FIG. 2 position, ports 30*a* and 30*b* communicate passage 19*a* with pump housing 24. Each pump assembly housing A carries a container supporting pedestal 32 having a partly enclosing side wall 32*a* for supporting an open-topped yogurt container y which is in position to be filled through a dispensing opening 33 provided above each pedestal 32 in communication with each valve recess R. It is to be understood that, when the valve 27 is rotated approximately 90° from the suction position in which it is shown in FIG. 2, port 30*e* of angle shaped passage system 30 will communicate with the dispensing opening 33 and deliver material ejected by the pump piston 25*a* through port 29 and the portion 30*b* of passage system 30 to dispensing opening 33 via port 30*e*. Mounted below valve housings 19 are a pair of semi-circular, detachable, orbiting, condensate collecting and spill trays 34, each having passages 34*a* beneath each opening 33 formed by riser walls 35 which are of greater height than the tray outer lips 36.

It will be seen that each pump plunger 25 includes an upper stem part 25*b* and a lower stem part 25*c*, joined by a coupling 37.

The rotatable tank-supporting annulus frame or cage C, which is journaled by a bearing 39, includes a top plate 41 to which an under plate 42 is bolted as at 43. Under plate 42 is bolted to the annular cage C as at 44. Depending from plate 42 is the flange 40 which is welded to shaft 14 and may be bolted to plate 42 as at 45. A pin 46 centrally disposed in openings 47, 48 and 49 in members 42, 41, and a bottom plate 16*b* for tank 16, respectively, is provided as shown to aid in locating the parts for assembly.

As FIG. 1 indicates, a guide ring 50, bolted to the cage C intermediate its length as at 51, mounts slide bearings 52 for the pump piston lower parts 25*c*, and a further guide ring 53 with slide bushings 54 for the piston stem parts 25*c* is also provided.

FIG. 1 shows a pump piston 25 in both an upper and lower position. Provided to guide each piston in its vertical travel relative to cage C, is a follower roller 55 received within a recessed guideway 56 formed in cage C. Each roller 55 is mounted on a threaded stem 55*a* received in a threaded opening 57 provided in a block 58 fixed to the lower stem part 25*c* of each piston 25.

The vertical position of each piston 25 at any time is determined by the vertical position of a cam follower roller 59 which is mounted in a block 60 dependent from each block 58. The vertical position of each roller 59 is influenced by either an upper arcuate cam part 61 or a lower annular cam part 62, dependent on its orbital position. The lower cam part 62 is fixedly secured to an angle plate 64 which is fixedly secured to frame F. The upper cam part 61 is pivotally secured as at 65 to a brace 66 projecting inwardly from frame F and mounted for vertical swinging movement upwardly and downwardly relative to fixed cam part 62 to vary the lower limit position of each plunger 25 and determine the volume of liquid dispensed according to the size of the container being filled. To accomplish the desired adjustment of upper cam part 61, a nut 67 pinned to the end of the cam part 61 as at 68, receives a screw 69 which is journaled by frame F as at 70. A gear 71 on the lower end of screw 69 is in mesh with a worm gear 72 fixed on an adjusting shaft 73 which is fixed against axial movement journaled by frame F. Preferably, a hand wheel 74 may be provided on shaft 73 to permit its manual rotation or, if desired, the shaft 73 could be motor driven. The lowermost positions of cam 61 and roller 59 are indicated at 61′ and 59′ respectively in FIG. 8.

Figure 4:
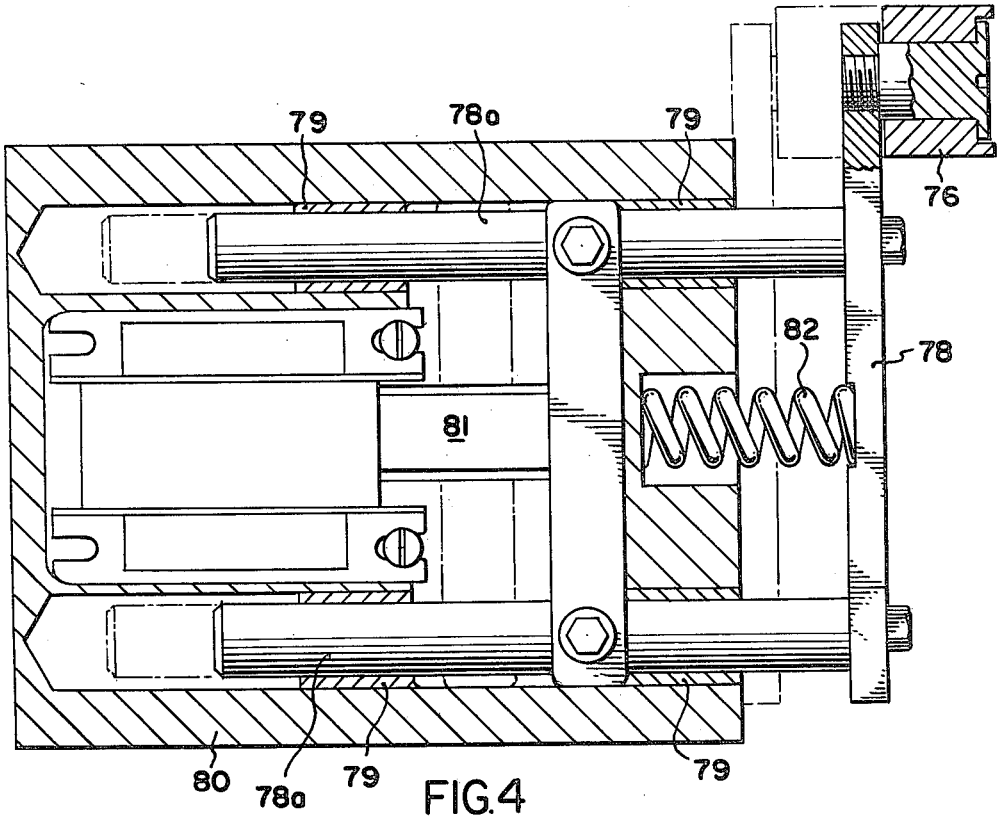
FIG. 4 is a sectional plan view of one of the abutments illustrating mechanism for retracting it when no container is in position to receive a charge of material from the pump.
Figure 3:
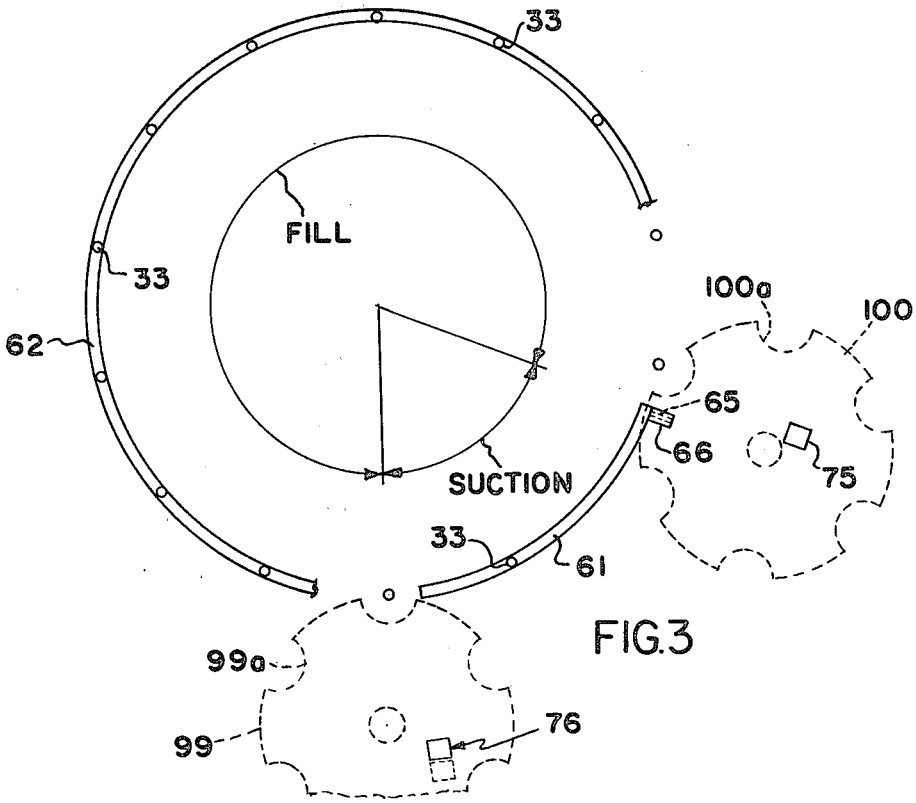
FIG. 3 is a schematic top plan view illustrating positions of the pump piston controlling cams and the abutments for shifting the dispensing valve handles to rotate the valves.

FIG. 3 schematically depicts the positions of the cam parts 61–62 and the valve 27 control or actuation abutments 75 and 76. These abutments are provided in the rotary path of the levers or handles 77 which are pinned as at 77*a* to the stem portion 27*a* of each valve 27, handles 77 having stems 77*b* received in bores 27*e* provided in the outer end of each valve 27. The abutment 75 is fixed in position and arranged to rotate the valves 27 approximately 90 degrees when the ends of the handles 77 strike them, to a suction position in which the port systems 30 is in communication with passages 19*a* and out of communication with openings 33. This occurs after the charge of material has been delivered to the container at a time when the pump pistons 25 are in "up" position. Abutment 76 normally reverses each valve 27 because it is at a different level in position to engage the opposite upper end of each handle 77 and cause it to swing in the opposite direction. It is to be observed, however, that the abutment 76 is retractable from normal position to a position in which it is radially out of the path of the handles 77 and will not activate them to move the valve bodies 27 to a dispensing position. For this reason, abutment 76 is mounted on a bar 78 (FIG. 4) having stems 78*a* received in bushings 79 provided in a solenoid casing 80. The stems 78*a* are in surrounding relation with a solenoid core 81 and spring 82 is provided to normally force bar 78 to outer normal position.

Figure 5:
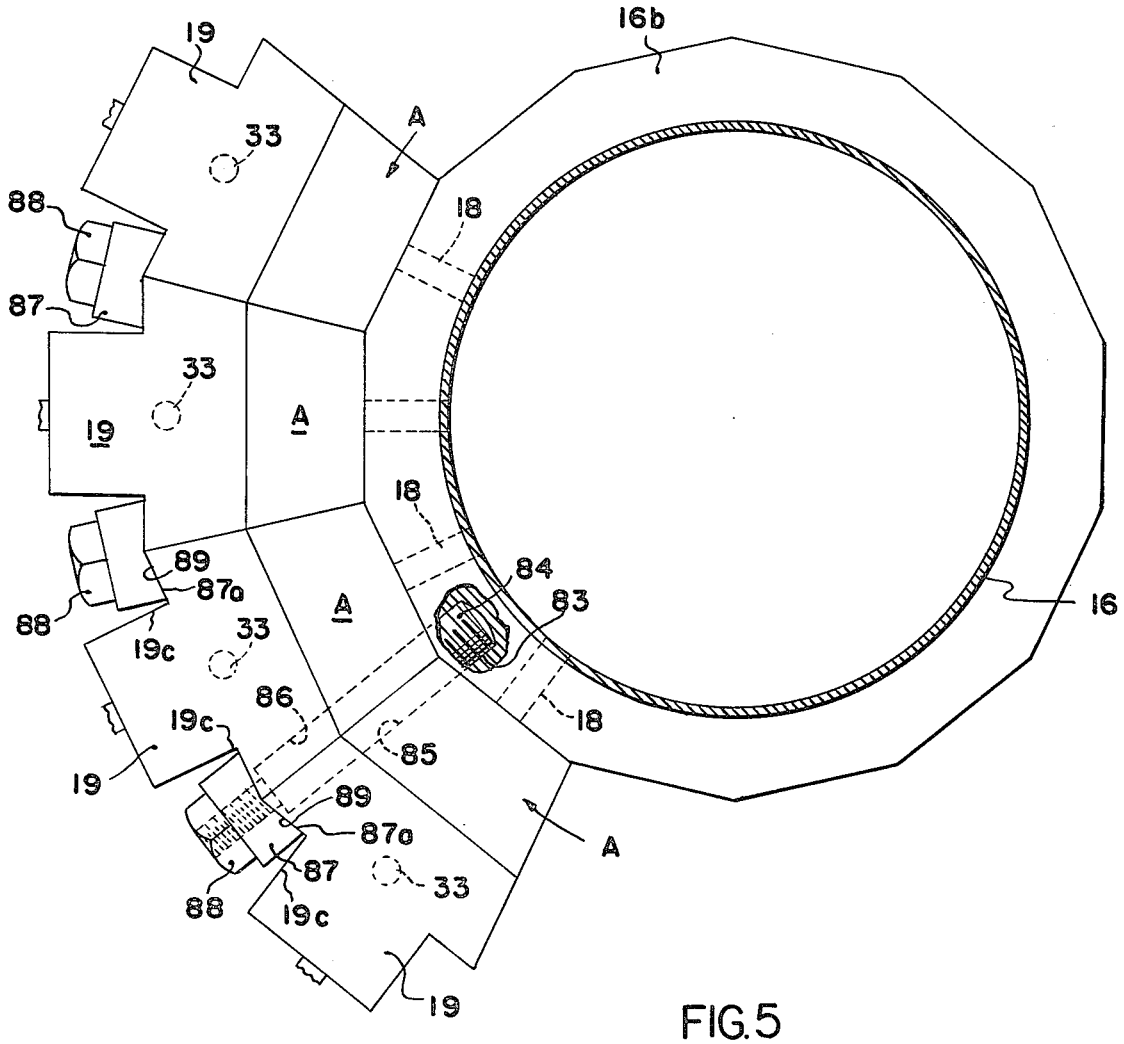
FIG. 5 is a fragmentary top plan view illustrating the manner in which the valve and pump housings are mounted for ready disassembly.
Figure 6:
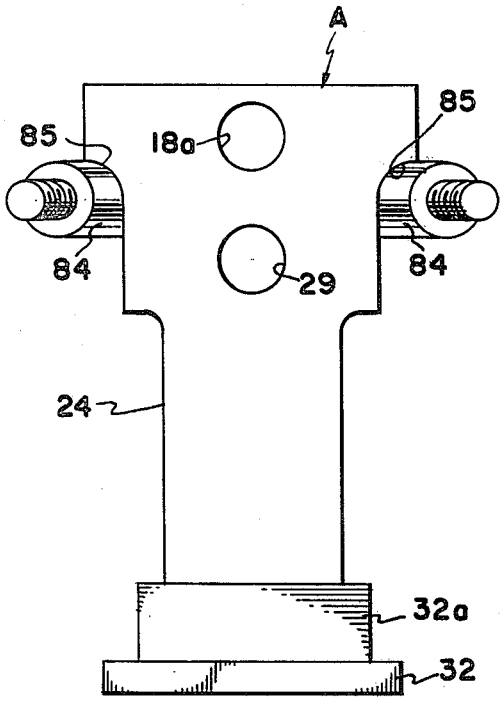
FIG. 6 is a front elevational view of one of the pump housings.
Figure 7:
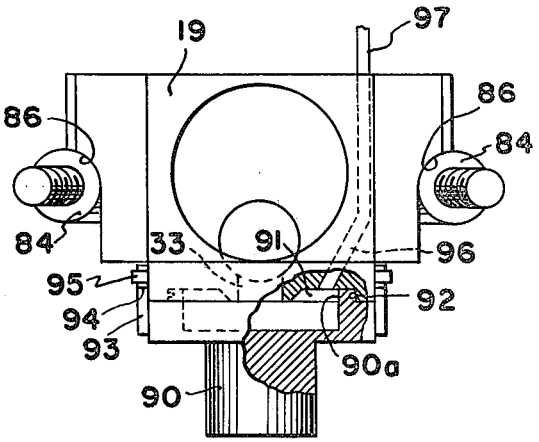
FIG. 7 is a front elevational view of one of the valve housings.

Certain critical parts are fabricated and assembled in a particular manner to permit their ready dis-assembly for periodic cleaning purposes. In addition a "clean-in-place" system is provided which is used to clean the parts on a daily basis. FIGS. 5 through 7 particularly indicate the manner in which the assemblies 19 and A are supported by the tank housing 16*b* in the manner which permits them to be easily dis-assembled. It will be observed that the outer perimeter of part 16*b* is a fourteen-sided polygon and it will further be observed that threaded openings 83 are provided in the tank part 16*b* at the junctures of the mounting walls of the portions 16*b* to accommodate mounting stud members 84.

As FIG. 6 particularly indicates, the housings A in front elevation are substantially T-shaped and include converging sockets 85 from which the assemblies A are suspended on studs 84. Likewise, (see FIG. 7) the assemblies 19, which also are generally T-shaped in front elevation, have converging sockets 86 to similarly suspend the assemblies 19 on the studs 84. Clamp washers 87 provided on the studs 84 may be secured by nuts 88 within recesses formed by shouldering the assemblies 19 as at 19*c*, and as will be seen have wedge walls 87*a* which engage with similarly inclined walls 89 on the assembly portions 19 to clamp the housings 19, and thereby the housings A, securely in position. To disassemble the housings 19 and A for cleaning and obtain access to passages 18, it is merely necessary to back off the nuts 88 and lift the parts 19 and A vertically from the studs 84. It is extremely easy likewise then to simply replace them in position again and tighten nuts 88 when reassembly is to be effected.

When it is desired to clean the critical parts of the assembly "in place", the semi-circular trays 34 are removed and plug members 90 (FIG. 7) are pushed up into position in the recessed openings 91 provided in housings 19 surrounding dispensing openings 33. Each plug 90 includes a shoulder portion 90*a* snugly fitting into opening 91 and has an O-ring or other suitable seal 92, as shown. To secure the plugs 90 in position, outboard walls 93 thereon have bayonet slots 94 for receiving pins 95 provided on the assemblies 19 and the plugs 90 are twisted to engage the pins 95 in the slots as the plugs 90 are moved into position. Leading upwardly from each assembly 19 from plug receiving chamber 91, is a passage 96 leading to a tube 97. Tube 97, as indicated in FIG. 1 leads back into tank 16.

In order to clean the assembly in place, each of the recesses 91 in each housing 19 is fitted with a plug 90 and water introduced through the tube 98 into the interior of tank 16 is then re-circulated through the assemblies A and 19 back to the tank 16 via ports 96 and hoses 97. Only one hose 97 has been shown in FIG. 1 but it is to be understood that each of the housings 19 may have a hose 97 or that a manifold (not shown) can be provided to which ports 96 lead and that a single hose may then lead from it back into tank 16. When a water flush has been accomplished, one of the parts 27 can be removed to drain the water from the system. Thereafter the process can be repeated with a sanitized cleaning solution, and suitable water and cleaning solution flushes can be alternated until the desired sanitary cleaning has been accomplished.

THE OPERATION

It is believed that the operation of the device will be readily understood from the foregoing description. In practice, as indicated in FIG. 3, a star wheel 99 is provided to deliver containers to each pedestal 32 as the pedestals move past the pockets 99*a* in the star wheel. Just prior to the time that a particular pedestal 32 reaches the container loading position, abutment 75 has been engaged by the handle 77 of the particular assembly 19 to rotate the particular valve 27 through substantially 90° to the "fill" position. At this time, the piston 25 is in its lowermost position, riding on the lower fixed cam 62. As the particular assembly rotates around, fixed cam 62 (see FIG. 8) moves the piston 25 upwardly to dispense fluid to the container and by the time fixed abutment 75 is reached, the dispensing operation has been completed. When the opposite end of handle 77 contacts abutment 75, the valve 27 is reversed to bring the valve 27 to the FIG. 2 position, and the suction stroke of the pump piston 25 can begin. By the time a container reaches the star wheel 100 and is removed by it, valve 27 has completely closed and the position of star wheel 100 is such that its pockets 100*a* engage and remove the container from each pedestal 32 at a point slightly downstream from the fixed abutment 75.

Figure 8:
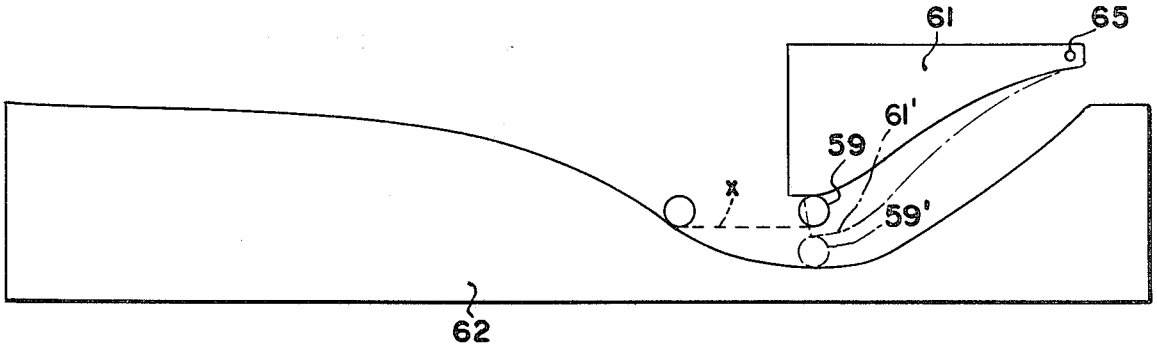
FIG. 8 is a diagrammatic side elevational view with the curvilinear cams shown as though they were linear, the chain lines illustrating another position of the swingable cam and the cam follower roller.

It is the upper cam 61 which moves the piston 25 downwardly in the suction stroke indicated in FIG. 3. As FIG. 8 demonstrates, the pivotal position of cam 61 determines the length of the suction stroke within certain predetermined limits to handle the volume requirements of various containers. In FIG. 8 the two extreme bottom positions of the follower rollers 59 are shown at 59 and 59' respectively. When the roller 59 is in the position indicated in solid lines in FIG. 8, it can move across to the cam surface of cam 62 in the path x and bypasses part of the cam surface 62.

I claim:

1. In a machine for dispensing liquid and semi-liquid material and the like in measured amounts to containers and having a supply tank with a plurality of circumferentially spaced radial tank outlet openings; a carrier for supporting a multiplicity of containers with open upper ends mounted for lateral orbiting movement with said tank; a filler pump and valve assembly, mounted to orbit with the carrier, and connected with said tank, the assembly having a plurality of passages communicating with the tank outlet openings, the assembly also having a plurality of separate pump communicating passages, and a plurality of separate dispensing openings disposed above the path of movement of the carrier and the containers thereon; the said passages being arranged in radially aligned sets, each having a tank outlet passage, a pump communicating passage, and a dispensing opening; said assembly also including a valve for each set with passage means in the valve in one position feeding material to the pump communicating opening from the tank outlet passage and in another position feeding material from the pump communicating opening to the dispensing opening; and a pump cylinder portion on said assembly for each passage set in communication with the pump communication opening of the set; each pump cylinder portion having a piston mounted for reciprocating movement in a suction and ejection stroke; arcuate cam track means about which the pump pistons orbit, the pistons being connected with followers moved by the cam track means to provide the stroke of the pistons and determine the amount of material moved by a pump piston out the dispensing opening of each set; the improvement wherein said frame has a sleeve, internally journaling a central shaft and externally journaling a cage hung from the upper part of said central shaft, the cage externally mounting the pistons for reciprocatory movement vertically and having a guide slot opposite each piston; guide means projects laterally from each piston and is receivable in one of said guide slots to prevent piston rotation; brace supports project radially from the tank assembly; said filler pump and valve assemblies have converging recesses at their sides permitting their suspension from a pair of said supports in a manner to be liftable vertically off the supports for individual cleaning; and means on said supports to individually releasably clamp said assemblies in place.

2. The apparatus as set forth in claim 1 wherein said cam track means comprises an upper track part and a lower track part, with a follower receiving surface on each; means is provided for pivotally mounting the upper track at one end for vertical swinging movements relative to the lower track, and actuating means is connected with the opposite end of said upper track for swinging it to change its vertical position.

3. The apparatus as set forth in claim 1 wherein plug members may be received by said assemblies to block said dispensing openings; passages in each of said assemblies to remove material blocked by one of said plugs to an exit port; and conduit means connects said exit ports.

4. In a machine for dispensing liquid and semi-liquid material and the like in measured amounts to containers and having a supply tank with a plurality of circumferentially spaced radial tank outlet openings; a frame; a carrier rotatable thereon for supporting a multiplicity of containers with open upper ends mounted for lateral orbiting movement with said tank; a filler pump and valve assembly, mounted to orbit with the carrier, and connected with said tank, the assembly having a plurality of passages communicating with the tank outlet openings, the assembly also having a plurality of separate pump communicating passages, and a plurality of separate dispensing openings disposed above the path of movement of the carrier and the containers thereon; the said passages being arranged in radially aligned sets, each having a tank outlet passage, a pump communicating passage, and a dispensing opening; said assembly also including a valve for each set with passage means in the valve in one position feeding material to the pump communicating opening from the tank outlet passage and in another position feeding material from the pump communicating opening to the dispensing opening; and a pump cylinder portion on said assembly for each passage set in communication with the pump communication opening of the set; each pump cylinder portion having a piston mounted for reciprocating movement in a suction and ejection stroke; arcuate cam track means about which the pump pistons orbit, the pistons being connected with followers moved by the cam track means to provide the stroke of the pistons and determine the amount of material moved by a pump piston out the dispensing opening of each set; the improvement wherein aligning supports project radially from the tank and said filler pump and valve assemblies have radially converging aligning sockets at their sides permitting their suspension from a pair of said supports in a manner to be liftable vertically off the supports for individual cleaning, and means on said supports individually releasably secures said assemblies in place.

5. The apparatus as set forth in claim 4 wherein the cam track means includes a pivotal portion which can be swung about one end to positions to change the extent of the stroke of each piston; and actuating means is connected with said pivotal portion for swinging it to change its position.

6. The apparatus as set forth in claim 4 wherein said frame has a sleeve internally journaling a driven central shaft and externally journaling a cage supported from one end of said central shaft; the cage externally mounting the pistons for reciprocating movement vertically and having means opposite each piston and connected therewith for preventing piston rotation.

7. The improvement as set forth in claim 4 wherein means is in each assembly to lock in a plug member to block the dispensing opening; passage means are provided in each of said assemblies in communication therewith to lead to an exit port; and conduit means connects all said exit ports with the tank to recirculate cleaning fluid thereto.

8. In a machine for dispensing liquid and semi-liquid material and the like in measured amounts to containers and having a supply tank with a plurality of circumferentially spaced radial tank outlet openings; a frame; a carrier rotatable thereon for supporting a multiplicity of containers with open upper ends mounted for lateral orbiting movement with said tank; a filler pump and valve assembly, mounted to orbit with the carrier, and connected with said tank, the assembly having a plurality of passages communicating with the tank outlet openings, the assembly also having a plurality of separate pump communicating passages, and a plurality of separate dispensing openings disposed above the path of movement of the carrier and the containers thereon; the said passages being arranged in radially aligned sets, each having a tank outlet passage, a pump communicating passage, and a dispensing opening; said assembly also including a valve for each set with passage means in the valve in one position feeding material to the pump communicating opening from the tank outlet passage and in another position feeding material from the pump communicating opening to the dispensing opening; and a pump cylinder portion on said assembly for each passage set in communication with the pump communication opening of the set; each pump cylinder portion having a piston mounted for reciprocating movement in a suction and ejection stroke; arcuate cam track means about which the pump pistons orbit, the pistons being connected with followers moved by the cam track means to provide the stroke of the pistons and determine the amount of material moved by a pump piston out the dispensing opening of each set; the improvement wherein recesses are provided in said assemblies surrounding said dispensing openings; plug members are lockably releasably receivable by said assemblies in said recesses outboard of said dispensing openings to block said recesses; and passages in each of said assemblies separated from the dispensing openings lead from the recesses and inner faces of said plug members through the assemblies to exit ports.

9. The apparatus as set forth in claim 8 wherein said cam track means includes a pivotal portion which can be swung about one end to positions to change the extent of the stroke of each piston; and actuating means is connected with said pivotal portion for swinging it to change its position.

10. The apparatus as set forth in claim 8 wherein said frame has a sleeve internally journaling a driven central shaft and externally journaling a cage hung from the upper part of said central shaft, the cage externally mounting the pistons for reciprocatory movement vertically.

11. The machine of claim 8 wherein said cam track means comprises an upper track part and a lower track part, with a follower receiving surface on each; the follower receiving surface on the lower surface of the upper track being downwardly inclined and the lower track receiving surface on the upper surface of the lower track being upwardly inclined; means for pivotally mounting the upper track about one end for vertical swinging movement about a generally horizontal axis; and means connecting said actuating means to the opposite end of the upper track to move it upwardly and downwardly about the pivot to positions which determine the extent of the downward suction stroke of each orbiting piston to vary its amplitude.

12. In a machine for dispensing liquid and semi-liquid material and the like in measured amounts to containers and having a supply tank with a plurality of circumferentially spaced radial tank outlet openings; a frame; a carrier rotatable thereon for supporting a multiplicity of containers with open upper ends mounted for lateral orbiting movement with said tank; drive means for revolving the carrier in 360° revolution; a filler pump and valve assembly, mounted to orbit with the carrier, and connected with said tank, the assembly having a plurality of passages communicating with the tank outlet openings, the assembly also having a plurality of separate pump communicating passages, and a plurality of separate dispensing openings disposed above the path of movement of the carrier and the containers thereon; the said passages being arranged in radially aligned sets, each having a tank outlet passage, a pump communicating passage, and a dispensing opening; said assembly also including a valve for each set with passage means in the valve in one position feeding material to the pump communicating opening from the tank outlet passage and in another position feeding material from the pump communicating opening to the dispensing opening; first valve actuating means located adjacent the orbital path of the carrier and said valves in an orbital position to actuate the valves to communicate the tank outlet passages with the pump communicating passages; second valve actuating means located adjacent the orbital path of the carrier and said valves in a downstream orbital position to actuate the valves to block the tank outlet passages to the pump and communicate the pump passages with the dispensing openings; the first and second valve actuating means being peripherally spaced to define a pump filling portion of the orbit and a dispensing portion of different orbital extent; and a vertically extending pump cylinder portion on said assembly for each passage set having one end in communication with the pump communication opening of the set; each pump cylinder portion having a piston mounted for reciprocating movement in a suction and ejection stroke; the pistons having rod portions extending from opposite ends of the cylinders connected with followers which are actuatable to provide the stroke of the pistons and determine the amount of material moved by a pump piston out the dispensing opening of each set; a peripherally extending, arcuate suction stroke controlling cam track extending angularly around only a portion of the orbital path of the carrier substantially from one valve actuating means to the other to define the pump filling suction portion of the orbit, and mounted by the frame for pivotal movement in a vertical plane about one of its ends; the cam track having a follower-engaged surface facing away from said cylinder portions and extending from said one end to an opposite free end; cam positioning means connected to swing the free end of the cam track upwardly and downwardly and hold it in a vertically selected position which determines the suction strokes of the pistons; a peripherally extending arcuate dispensing stroke controlling cam track extending angularly around a remaining portion of the path of the carrier from said second valve actuating means back toward the first valve actuating means in a downstream direction, the dispensing stroke cam track having a follower-engaged surface facing oppositely to the surface of the suction stroke controlling cam track for positively moving the pistons in their dispensing strokes; the dispensing stroke controlling cam track being spaced vertically from the free end of the pump filling stroke cam track a distance greater than the vertical extent of the followers sufficiently to permit the free end of the pump filling stroke cam track to assume a range of vertical positions and the followers to proceed orbitally beyond said free end before engaging the dispensing stroke controlling cam track.

13. The apparatus as set forth in claim 12 wherein said frame has a sleeve internally journaling a driven central shaft and externally journaling cage means supported from one end of said central shaft; the cage means externally mounting the pistons for reciprocatory movement vertically.

14. The apparatus as set forth in claim 12 wherein securing braces project radially from the tank and said filler pump and valve assemblies have converging sockets at their sides permitting their suspension from a pair of said braces; and means for clamping each assembly individually in releasable position.

15. The apparatus as set forth in claim 12 wherein said assemblies have means surrounding said dispensing openings to receive plug members; and passages in said assemblies lead from the inner faces of said plug members through the assemblies to exit ports.

* * * * *